US008328314B2

(12) United States Patent
Izoe

(10) Patent No.: US 8,328,314 B2
(45) Date of Patent: Dec. 11, 2012

(54) PRINT CONTROLLER

(75) Inventor: Shintaro Izoe, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 326 days.

(21) Appl. No.: 12/729,785

(22) Filed: Mar. 23, 2010

(65) Prior Publication Data

US 2010/0245439 A1 Sep. 30, 2010

(30) Foreign Application Priority Data

Mar. 27, 2009 (JP) ..... 2009-078254

(51) Int. Cl.
*B41J 29/38* (2006.01)

(52) U.S. Cl. ..... 347/14

(58) Field of Classification Search ..... None
See application file for complete search history.

(56) References Cited

U.S. PATENT DOCUMENTS

| | | | | |
|---|---|---|---|---|
| 5,978,506 | A | 11/1999 | Murayama et al. | |
| 2004/0090480 | A1* | 5/2004 | Teshikawara et al. | 347/15 |
| 2006/0132524 | A1 | 6/2006 | Ikegame | |
| 2006/0244774 | A1* | 11/2006 | Arazaki et al. | 347/19 |
| 2008/0079761 | A1 | 4/2008 | Furuya | |
| 2008/0252673 | A1* | 10/2008 | Wada et al. | 347/12 |

FOREIGN PATENT DOCUMENTS

| | | | |
|---|---|---|---|
| JP | H09-186899 | A | 7/1997 |
| JP | 2006-199031 | A | 8/2006 |
| JP | 2006-205490 | A | 8/2006 |
| JP | 2006-334871 | A | 12/2006 |
| JP | 2008-012848 | A | 1/2008 |
| JP | 2008-087358 | A | 4/2008 |
| JP | 2008-221832 | A | 9/2008 |

* cited by examiner

*Primary Examiner* — Stephen Meier
*Assistant Examiner* — Tracey McMillion
(74) *Attorney, Agent, or Firm* — Baker Botts L.L.P.

(57) ABSTRACT

An inkjet head has a plurality of nozzles that are arranged such that distances in a first direction between respective two adjacent nozzles that are adjacent with each other in the first direction are uniform and distances in a second direction orthogonal to the first direction between the respective two adjacent nozzles are nonuniform. The storing unit stores a plurality of dot size determining values corresponding to the plurality of nozzles. Each dot size determining value is defined to determine a size of a dot to be formed by the corresponding nozzle and is determined dependently on a distance in the second direction between the corresponding nozzle and a nozzle adjacent to the corresponding nozzle in the first direction. The determining unit determines a size of a dot to be formed by each nozzle based on the pixel data and the corresponding dot size determining value.

13 Claims, 7 Drawing Sheets

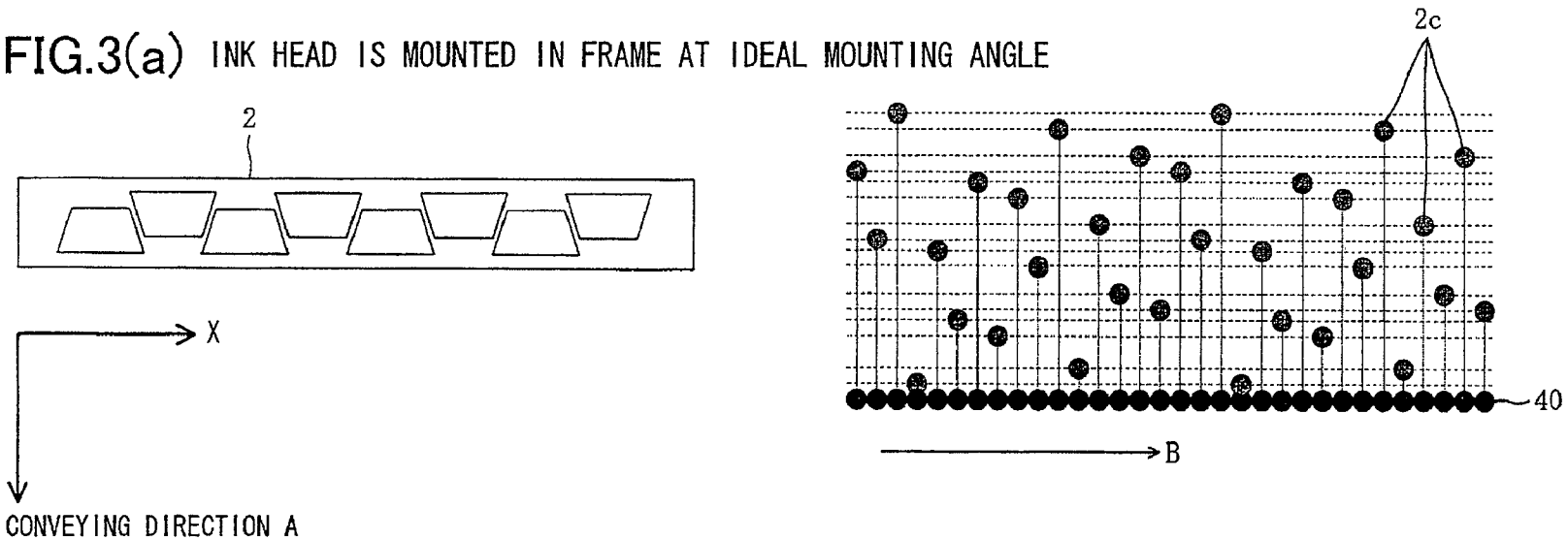
FIG.3(a) INK HEAD IS MOUNTED IN FRAME AT IDEAL MOUNTING ANGLE
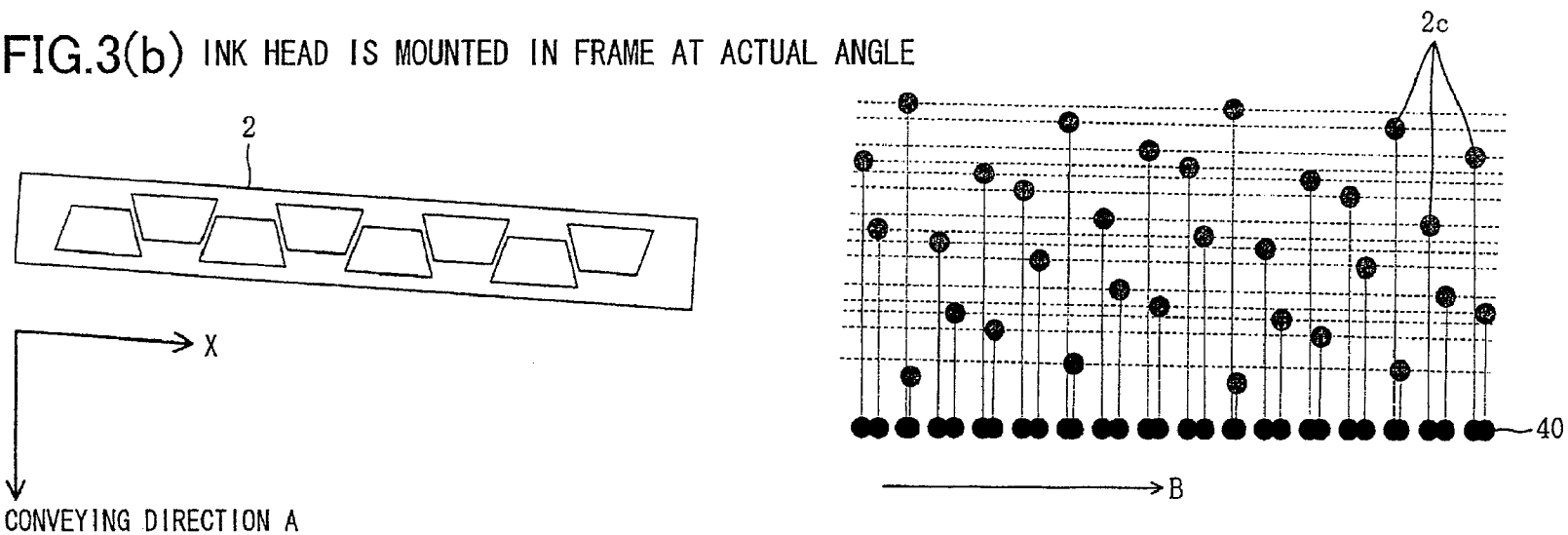
FIG.3(b) INK HEAD IS MOUNTED IN FRAME AT ACTUAL ANGLE FIG.5(a) DOT SIZE TABLE 12a

| | DOT SIZE VALUE SET 1 | DOT SIZE VALUE SET 2 | DOT SIZE VALUE SET 3 |
|---|---|---|---|
| LARGE DOT SIZE VALUE | 6 | 7 | 8 |
| MEDIUM DOT SIZE VALUE | 3 | 4 | 5 |
| SMALL DOT SIZE VALUE | 1 | 2 | 3 |

FIG.5(b) DOT SIZE ADJUSTING TABLE 14a

| | DOT SIZE VALUE SET |
|---|---|
| FIRST NOZZLE | 1 |
| SECOND NOZZLE | 2 |
| THIRD NOZZLE | 2 |
| FOURTH NOZZLE | 3 |
| FIFTH NOZZLE | 3 |
| ⋮ | ⋮ |
| M-TH NOZZLE | 2 |

FIG.5(c) Y-DIRECTION NOZZLE DISTANCE TABLE

| | DISTANCE [mm] |
|---|---|
| GAP BETWEEN FIRST AND SECOND NOZZLES | 10 |
| GAP BETWEEN SECOND AND THIRD NOZZLES | -5 |
| GAP BETWEEN THIRD AND FOURTH NOZZLES | 6 |
| GAP BETWEEN FOURTH AND FIFTH NOZZLES | -8 |
| ⋮ | ⋮ |
| GAP BETWEEN (M-1)-TH AND M-TH NOZZLES | 2 |

$$d_{r1} = x\cos\theta + y_1\sin\theta \qquad (y_1 > 0)$$

$$d_{r2} = x\cos\theta + y_2\sin\theta \qquad (y_2 < 0)$$

$$d_{r3} = x\cos\theta + y_3\sin\theta \qquad (y_3 > 0)$$

PRINT CONTROLLER

CROSS REFERENCE TO RELATED APPLICATION

This application claims priority from Japanese Patent Application No. 2009-078254 filed Mar. 27, 2009. The entire content of the priority application is incorporated herein by reference.

TECHNICAL FIELD

The present invention relates to a print controller, a printing device, and a method for setting the printing device.

BACKGROUND

An inkjet printer well known in the art prints images by ejecting ink droplets through nozzles to form dots on recording paper. However, manufacturing error may cause the impact positions of ink droplets ejected from this inkjet printer to deviate from intended positions, producing white streaks in the image called "banding" that reduces the overall image quality. Banding is a white area of the recording paper that appears as a white line when the gap between adjacent dots grows too large.

Two types of inkjet printers are a multi-pass printer and a line head printer. The multi-pass printer prints images on recording paper by ejecting ink droplets through nozzles formed in the ink head while reciprocating the ink head in a main scanning direction orthogonal to the paper-conveying direction. The line head printer, on the other hand, has a very long print head, equivalent to or greater than the width of the recording paper and having rows of nozzles capable of forming dots in full line units so that the printer can print images without reciprocating the ink head.

The multi-pass printer can suppress the above-mentioned problem of banding to a degree by adjusting the distance between dots in the main scanning direction orthogonal to the paper-conveying direction based on the position of the ink head in the main scanning direction. However, since the ink head is not reciprocated in a line head printer, the distance between dots in the direction orthogonal to the paper-conveying direction is fixed based on the positions of the nozzles and is very difficult to adjust. Hence, the line head printer is susceptible to banding caused by a gap between dots at the same position relative to the longitudinal direction of the print head when the gaps are linked in a series extending in the paper-conveying direction.

One conventional image-forming device has a long ink head constructed by linking a plurality of heads in the longitudinal direction so that the ends of adjacent heads overlap. This conventional image-forming device suppresses banding by adjusting the size of ink dots ejected from nozzles in areas that the ink heads overlap. Another conventional image-forming device prevents a decline in the width of an image caused by inclination in the print head by adding an extra pixel or modifying the size of the dots.

SUMMARY

In view of the foregoing, it is an object of the invention to provide a print controller, a printing device, and a method for setting the printing device, capable of suppressing banding in images.

In order to attain the above and other objects, the invention provides a print controller controlling an inkjet head to eject ink to record an image on a recording medium conveyed in a conveying direction. The inkjet head has a plurality of nozzles that are arranged such that distances in a first direction between respective two adjacent nozzles that are adjacent with each other in the first direction are uniform and distances in a second direction orthogonal to the first direction between the respective two adjacent nozzles are nonuniform. The print controller includes an acquiring unit, a storing unit, and a determining unit. The acquiring unit acquires image data representing an image having a plurality of pixels. The image data includes a plurality of sets of pixel data corresponding to the plurality of pixels. The storing unit stores a plurality of dot size determining values corresponding to the plurality of nozzles. Each dot size determining value is defined to determine a size of a dot to be formed by the corresponding nozzle and is determined dependently on a distance in the second direction between the corresponding nozzle and a nozzle adjacent to the corresponding nozzle in the first direction. The determining unit determines a size of a dot to be formed by each nozzle based on the pixel data and the corresponding dot size determining value.

According to another aspect, the invention provides a printing device. The printing device includes an inkjet head, an acquiring unit, a storing unit, and a determining unit. The inkjet head ejects ink to record an image on a recording medium conveyed in a conveying direction. The inkjet head has a plurality of nozzles that are arranged such that distances in a first direction between respective two adjacent nozzles that are adjacent with each other in the first direction are uniform and distances in a second direction orthogonal to the first direction between the respective two adjacent nozzles are nonuniform. The acquiring unit acquires image data representing an image having a plurality of pixels. The image data includes a plurality of sets of pixel data corresponding to the plurality of pixels. The storing unit stores a plurality of dot size determining values corresponding to the plurality of nozzles. Each dot size determining value is defined to determine a size of a dot to be formed by the corresponding nozzle and is determined dependently on a distance in the second direction between the corresponding nozzle and a nozzle adjacent to the corresponding nozzle in the first direction. The determining unit determines a size of a dot to be formed by each nozzle based on the pixel data and the corresponding dot size determining value.

According to still another aspect, the invention provides a method for setting a printing device having an inkjet head to record an image on a recording medium conveyed in a conveying direction. The inkjet head has a plurality of nozzles that are arranged such that distances in a first direction between respective two adjacent nozzles that are adjacent with each other in the first direction are uniform and distances in a second direction orthogonal to the first direction between the respective two adjacent nozzles are nonuniform. The method includes acquiring an angle between the first direction and a third direction orthogonal to the conveying direction, calculating, for each nozzle, a distance in the third direction between two dots which are to be formed by the each nozzle and another nozzle adjacent to the each nozzle in the first direction and which are to be arranged in the third direction wherein the distance is calculated based on the angle, and setting a plurality of dot size determining values corresponding to the plurality of nozzles dependently on a distance in the second direction between the corresponding nozzle and a nozzle adjacent to the corresponding nozzle in the first direction wherein each dot size determining value is set to determine a size of a dot to be formed by the corresponding nozzle.

BRIEF DESCRIPTION OF THE DRAWINGS

The particular features and advantages of the invention as well as other objects will become apparent from the following description taken in connection with the accompanying drawings, in which:

FIG. 2(*b*) is an enlarged view of a nozzle unit;

FIG. 2(*c*) is an explanatory diagram illustrating rules for arranging nozzles in the nozzle unit;

FIG. 3(*a*) shows a relationship between an ideal mounting angle of the ink head and a row of dots formed by the ink head on a paper;

FIG. 3(*b*) shows a relationship between an incorrect mounting angle of the ink head and a row of dots formed by the ink head on a paper;

FIG. 5(*a*) is an explanatory diagram conceptually illustrating a structure of a dot size table;

FIG. 5(*b*) is an explanatory diagram conceptually illustrating a structure of a dot size adjusting table;

FIG. 5(*c*) is an explanatory diagram conceptually illustrating a structure of a Y-direction nozzle distance table;

FIG. 7(*b*) is an explanatory diagram illustrating a method of calculating an ideal large dot size.

DETAILED DESCRIPTION

Figure 1:
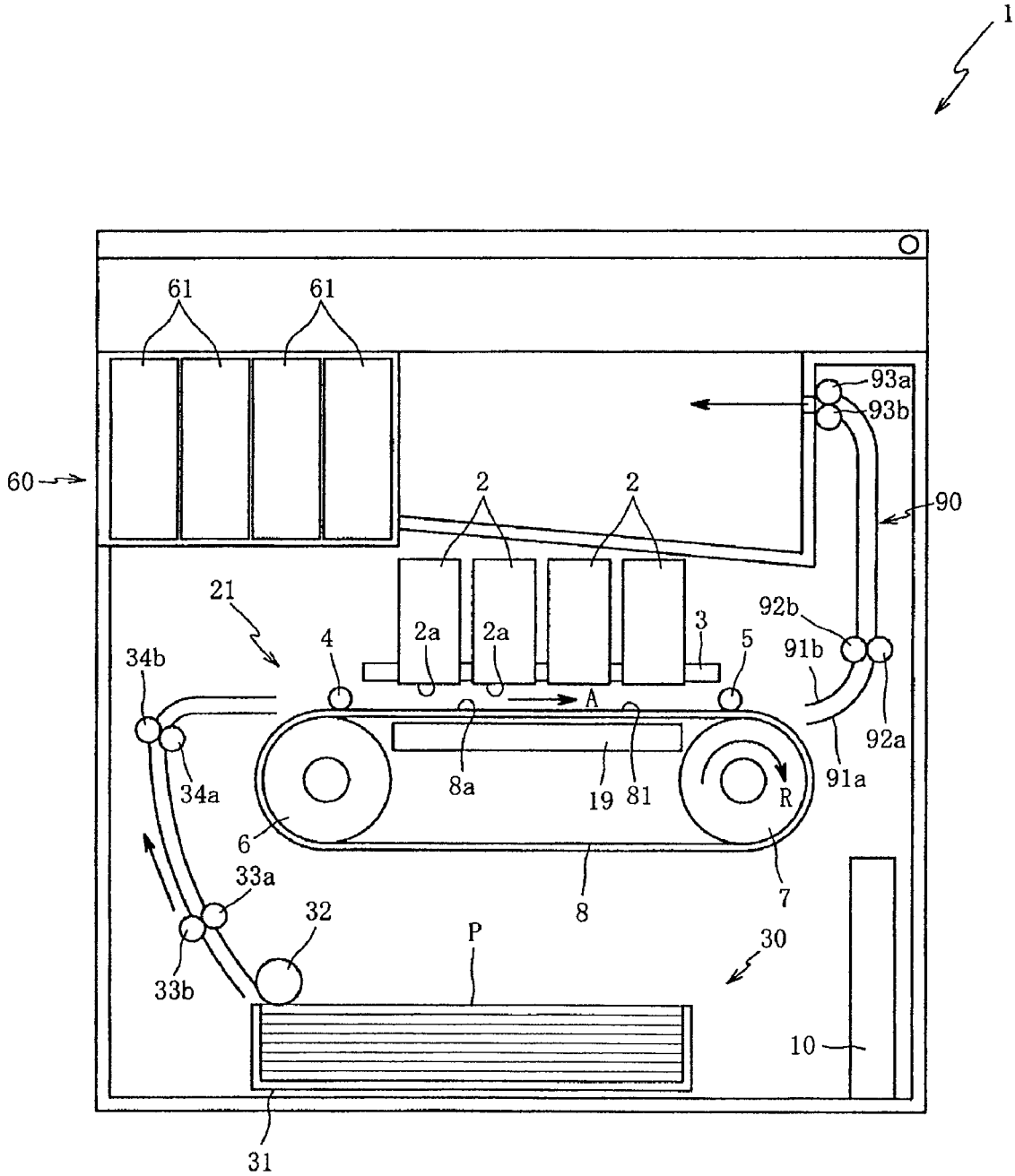
FIG. 1 is a cross-sectional view of a printer equipped with a controller according to an embodiment of the invention.

A printer 1 according to an embodiment of the invention will be described while referring to the accompanying drawings wherein like parts and components are designated by the same reference numerals to avoid duplicating description.

FIG. 1 is a cross-sectional view of the printer 1 equipped with a controller 10 serving as an embodiment of the print controller according to the invention. The printer 1 is a line head type inkjet printer capable of suppressing banding in images printed on a recording paper P.

As shown in FIG. 1, the printer 1 is provided with an ink head 2 for each color of ink employed by the printer 1, and a conveying mechanism 21 for conveying the sheets of paper P to the ink heads 2. The sheets of paper P are originally stacked in a sheet-feeding unit 30 disposed in the bottom section of the printer 1. The conveying mechanism 21 conveys the sheets toward the ink heads 2 along a conveying direction A indicated by an arrow in FIG. 1. After a prescribed image is printed on a sheet, the sheet is conveyed to a discharge section 90.

The sheet-feeding unit 30 includes a paper tray 31 capable of accommodating sheets of paper P in a stacked formation, and a feeding roller 32. The feeding roller 32 picks up the topmost sheet of paper P among the plurality of sheets stacked in the paper tray 31 and conveys the paper P one sheet at a time toward the conveying mechanism 21.

Two pairs of conveying rollers 33*a* and 33*b*, and 34*a* and 34*b* are disposed between the sheet-feeding unit 30 and the conveying mechanism 21 along the conveying path of the paper P. The conveying rollers 33*a* and 33*b* and the conveying rollers 34*a* and 34*b* guide and convey sheets of paper P received from the sheet-feeding unit 30 toward the conveying mechanism 21.

The conveying mechanism 21 includes an endless conveying belt 8 and two belt rollers 6 and 7. The belt roller 7 is linked to a conveying motor 22 (see FIG. 4) and is driven to rotate in a direction R indicated by an arrow in FIG. 1 by a rotational force transmitted from the conveying motor 22. When the belt roller 7 rotates in the direction R, the conveying belt 8 circulates in a direction for conveying the sheets of paper P in the conveying direction A, while the belt roller 6 rotates as a follow roller. The conveying belt 8 includes an outer surface 8*a*. The outer surface 8*a* has marks 81 indicating a direction B orthogonal to the paper conveying direction.

A nip roller 4 is disposed at a position opposing the belt roller 6, with the conveying belt 8 interposed therebetween. The nip roller 4 presses sheets of paper P conveyed from the sheet-feeding unit 30 against the outer surface 8*a* so as to hold the entire sheet against the outer surface 8*a*. In this state, the sheets of paper P carried on the conveying belt 8 are conveyed past the ink heads 2.

An ink head 2 is provided for each of four ink colors (cyan, magenta, yellow, and black). Each ink head 2 extends along the width dimension of the conveying belt 8. The ink heads 2 are supported in a frame 3 so as to be parallel to each other and juxtaposed along the conveying direction A. Each ink head 2 includes a ink ejection surface 2*a*. The ink ejection surface 2*a* is formed with nozzles 2*c* (FIG. 2) that eject ink droplets. Each ink head 2 is connected to an ink storage section 60 via a tube. Four ink cartridges 61, each storing one of the four colors of ink, are disposed in the ink storage section 60 and supply ink of their respective colors to the corresponding ink heads 2. In the embodiment, the ink ejection surface 2*a* includes a photosensor 25 to read the marks 81.

A platen 19 is disposed inside the loop formed by the conveying belt 8. The platen 19 is shaped substantially like a rectangular parallelepiped and confronts the bottom surfaces (ink ejection surfaces 2*a*) of the four ink heads 2. The top surface of the platen 19 contacts the inner surface of the conveying belt 8 and supports the conveying belt 8 through this contact.

The printer 1 forms an image on the paper P when a sheet of paper P held on the conveying belt 8 passes, in the conveying direction A, sequentially under the four ink heads 2. When a sheet passes under each ink head 2, the nozzles 2*c* (see FIG. 2) eject ink droplets that impact the paper P and form dots thereon. Each ink head 2 forms dots a row at a time along the direction B orthogonal to the conveying direction A. By repeatedly and alternately controlling the conveying belt 8 to convey the sheet one row worth and controlling each ink head 2 to form one row worth of dots, the printer 1 can form multiple rows of dots one after another on the paper P in the conveying direction A to print an image on the paper P. After the image is printed, the conveying mechanism 21 conveys the sheet downstream toward the discharge section 90.

A spur roller 5 is disposed above the belt roller 7. When a sheet of paper P conveyed by the conveying mechanism 21 becomes interposed between the spur roller 5 and the conveying belt 8, the spur roller 5 applies an additional conveying force to the sheet to discharge the sheet from the conveying mechanism 21. The sheets conveyed by the conveying mechanism 21 in the conveying direction A are separated from the outer surface 8*a* of the conveying belt 8 by a separating member (not shown) and conveyed to the discharge section 90. The discharge section 90 includes a pair of guides 91*a* and 91*b* and two pairs of conveying rollers 92*a* and 92*b*, and 93*a* and 93*b*. The conveying rollers 92*a* and 92*b* and the conveying rollers 93*a* and 93*b* convey the paper P upward between the guides 91*a* and 91*b* and discharge the paper P from the printer 1.

Figure 2A:
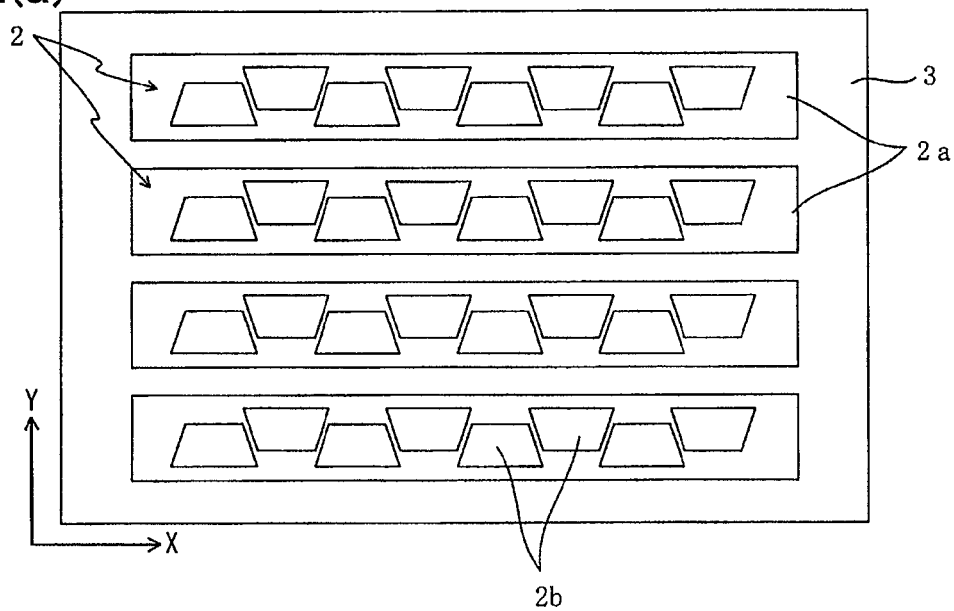
FIG. 2(*a*) is a bottom view of ink heads showing ink ejection surfaces.
Figure 2B:
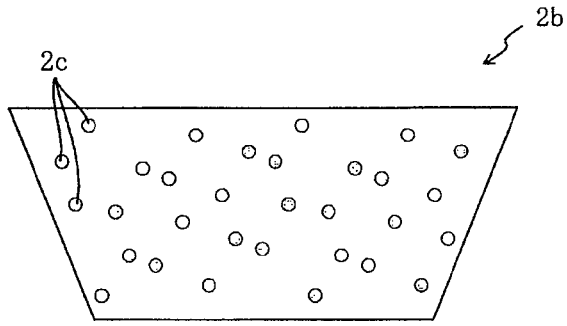
Figure 2C:
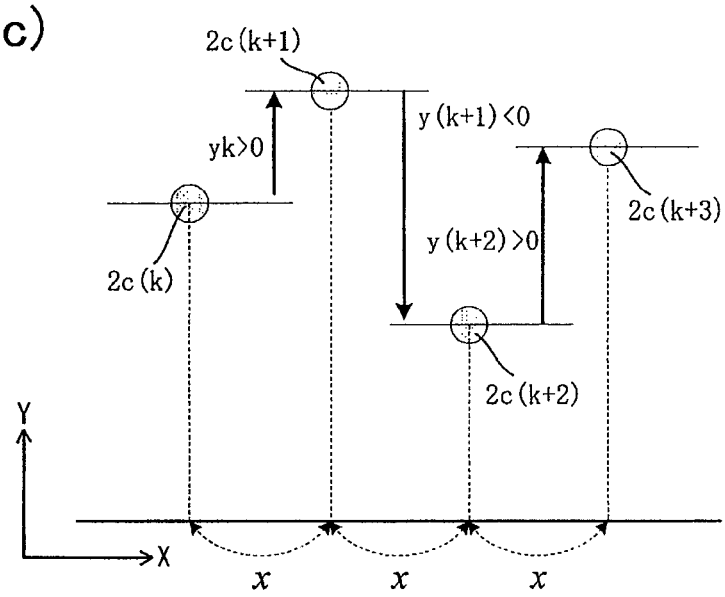

FIG. 2(*a*) is a bottom view of the ink heads 2 showing the ink ejection surfaces 2*a*. As shown in FIG. 2(*a*), each ink head 2 has an elongated structure with trapezoidal nozzle units 2*b* disposed in a staggered arrangement along a row in the longitudinal direction of the ink head 2. In the following description, the longitudinal direction of the ink head 2 will be referred to as the X direction, while the direction orthogonal to the X direction along the ink ejection surface 2*a* will be referred to as the Y direction. Ideally, the ink heads 2 are mounted in the frame 3 so that the X direction is at a right angle to the conveying direction A for the paper P (see FIG. 1). However, according to the printer 1 of the embodiment, the X direction is shifted from the direction B by an angle θ because of manufacturing error.

FIG. 2(*b*) is an enlarged view of a nozzle unit 2*b*. FIG. 2(*c*) is an explanatory diagram illustrating the rules for arranging the nozzles 2*c* in the nozzle unit 2*b*. As illustrated in FIGS. 2(*b*) and 2(*c*), a plurality of nozzles 2*c* is formed in each nozzle unit 2*b*. The nozzles 2*c* are arranged so that the nozzle distance in the X direction is uniform (a distance x in the example shown in FIG. 2(*c*)).

On the other hand, the positions of the nozzles 2*c* in the Y direction are not uniform. Therefore, when ink droplets are ejected from all nozzles 2*c* in a single ink head 2 at the same timing, dots are formed at irregular positions on the paper P in the conveying direction A. That is, dots cannot be formed along a single row. Therefore, the controller 10 must control the ink ejection timing for each nozzle 2*c* based on the position of the nozzles 2*c* in the Y direction in order to form a dot row 40 (see FIGS. 3(*a*) and 3(*b*)) aligned in the direction B. Specifically, to form a dot row 40 orthogonal to the conveying direction A on the paper P, the controller 10 forms dots by ejecting ink droplets from nozzles 2*c* positioned on the upstream side in the conveying direction A, conveys the paper P until the line on which the previous dots were formed is directly beneath the nozzles 2*c* positioned downstream in the conveying direction A, and subsequently ejects ink droplets from these downstream positioned nozzles 2*c*.

In addition, the nozzles 2*c* are arranged in each nozzle unit 2*b* so that their positions in the Y direction alternate between the upstream side and downstream side in the conveying direction A with respect to one other. FIG. 2(*c*) shows a part of the nozzles 2*c* arranged in the X direction in the ink head 2. More specifically, when a $(k+1)^{th}$ nozzle 2*c*(k+1) is positioned upstream in the conveying direction A (the upper side in the example shown in FIG. 2(*c*)) relative to a $k^{th}$ nozzle 2*c*(k), a $(k+2)^{th}$ nozzle 2*c*(k+2) is positioned downstream in the conveying direction A (the lower side in the example shown in FIG. 2(*c*)) relative to the $(k+1)^{th}$ nozzle 2*c*(k+1).

As shown in FIG. 2(*c*), in the embodiment, Y coordinates are set such that all points upstream in the conveying direction A is positive and all points downstream is negative. Positional change y(k) in the Y direction of the $(k+1)^{th}$ nozzle 2*c*(k+1) relative to the $k^{th}$ nozzle 2*c*(k) is specified using these Y coordinates. The direction (sign) of this change (y(k)) in the example shown in FIG. 2(*c*) is positive. Thus, the position of the nozzles 2*c* in the Y direction must be set so that the direction (sign) of positional change (y(k+1)) in the Y direction of the $(k+2)^{th}$ nozzle 2*c*(k+2) relative to the $(k+1)^{th}$ nozzle 2*c*(k+1) is negative. In other words, the nozzles 2*c* are arranged in the Y direction so that the direction of change alternates in the Y direction between sequential pairs of nozzles 2*c* adjacent in the X direction.

Arranging the nozzles 2*c* in this way facilitates the formation of ink channels used to supply ink separately to each nozzle unit 2*b*. Here, FIG. 2(*b*) simply illustrates a pattern of the nozzles 2*c*. In actuality, a much larger number of nozzles 2*c* are formed in each nozzle unit 2*b* in a denser arrangement, but showing all nozzles 2*c* would make the drawing cumbersome and complicated.

FIGS. 3(*a*) and 3(*b*) show the relationship between the mounted angle of the ink head 2 and a row of dots formed by the ink head 2 on the paper P. The left side of FIG. 3(*a*) shows an ink head 2 mounted in the frame 3 at an ideal mounting angle so that the X direction (longitudinal direction) of the ink head 2 is orthogonal to the conveying direction A, while the right side of FIG. 3(*a*) shows the relationship between the arrangement of nozzles 2*c* in the ink head 2 and the dot row 40 formed by the ink head 2. Here, the longitudinal direction of the dot row 40 is parallel to the direction B, which is orthogonal to the conveying direction A.

When the ink head 2 is mounted at the ideal angle shown in FIG. 3(*a*), the X direction of the ink head 2 is aligned with the B direction (longitudinal direction of the dot row 40 formed on the paper P). Hence, the distance between dots formed on the dot row 40 is equivalent to the distance between corresponding nozzles 2*c* in the X direction. Thus, if the nozzles 2*c* are formed in the ink head 2 at a regular pitch in the X direction, the distance between dots in the dot row 40 formed on the paper P will be regular and equivalent to the pitch between nozzles 2*c* in the X direction. In this case, the problem of banding does not occur in the image.

The left side of FIG. 3(*b*) illustrates the ink head 2 mounted in the frame 3 at an incorrect mounting angle so that the X direction of the ink head 2 is not aligned with the direction orthogonal to the conveying direction A, while the right side shows the relationship between the arrangement of nozzles 2*c* in the ink head 2 and the dot row 40 formed by the ink head 2. In this example, the X direction of the ink head 2 is shifted relative to the B direction. Hence, even when the pitch between nozzles 2*c* in the X direction is regular, the distance between dots constituting the dot row 40 is irregular, producing different levels of dot density in the dot row 40.

Specifically, when the X direction of the ink head 2 is shifted relative to the B direction, the distance between dots in the dot row 40 is equivalent to the sum of the B directional component for the distance in the X direction between nozzles 2*c* corresponding to the dots, and the B directional component for the distance in the Y direction between nozzles 2*c* corresponding to the dots. The method of calculating the distance between dots will be described later with reference to FIG. 7(*a*). Since the nozzles 2*c* are arranged at irregular positions in the Y direction, as described with reference to FIG. 2(*c*), the B directional component for the distance between nozzles 2*c* in the Y direction differs according to the nozzles 2*c*. As a result, the distance between neighboring dots in the dot row 40 is quite varied, producing different levels of dot density.

This varied dot density will appear in all dot rows 40 formed by the same ink head 2. Therefore, when the distance between dots at certain positions in the dot row 40 is great, resulting in a gap between the dots, a line extending in the conveying direction A (banding) may appear in the printed image if such gaps are formed in a continuous series along the conveying direction A.

Therefore, the controller 10 according to the embodiment suppresses banding in images by adjusting the amount of ink ejected from each nozzle 2*c* so that a pair of nozzles adjacent in the X direction form larger dots when the distance between the dots is large.

Figure 4:
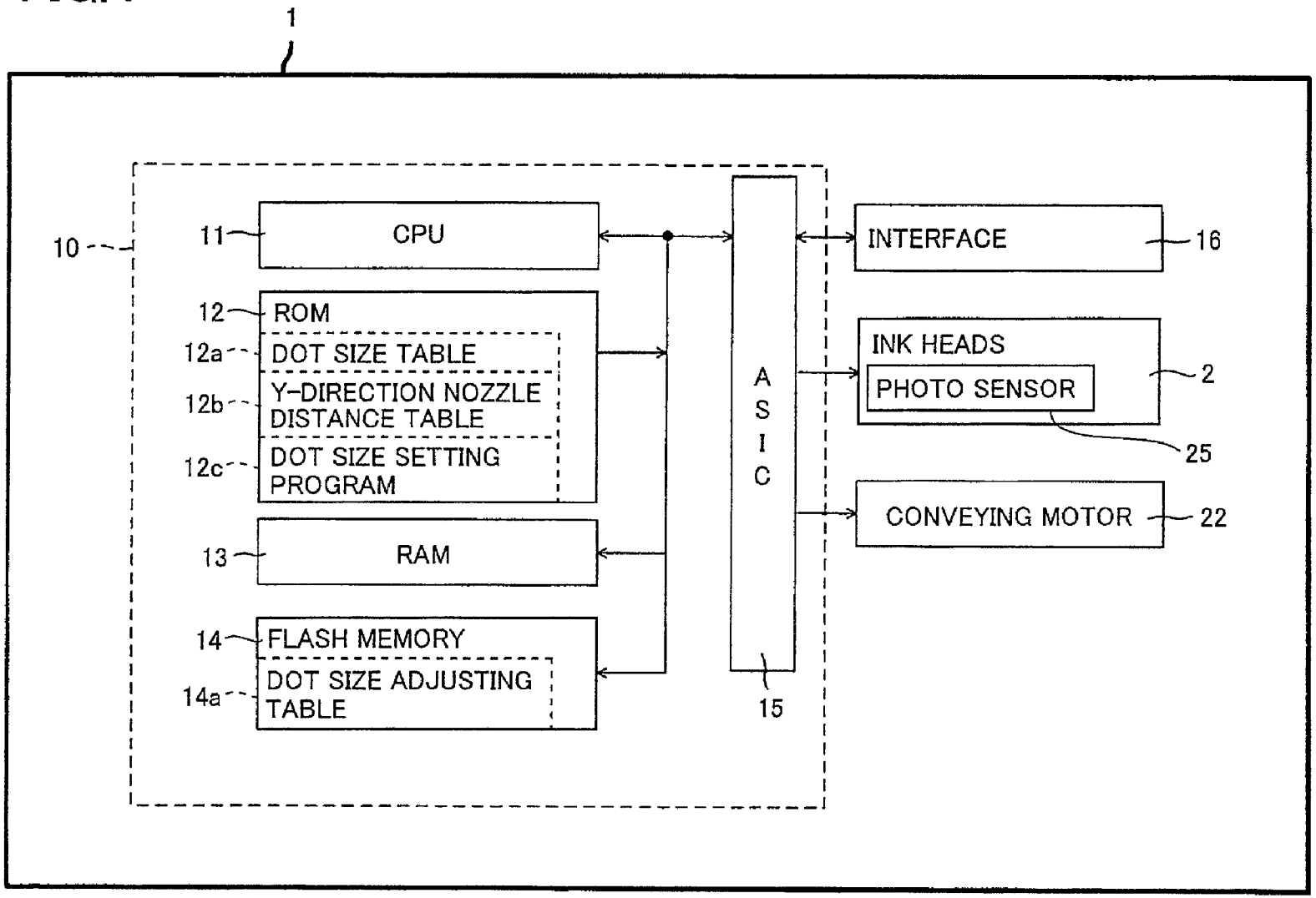
FIG. 4 is a block diagram showing an electrical structure of the printer.

FIG. 4 is a block diagram showing the electrical structure of the printer 1. As shown in FIG. 4, the printer 1 primarily includes the controller 10, an interface 16, the ink heads 2, and the conveying motor 22.

The controller 10 further includes a CPU 11, a ROM 12, a RAM 13, a flash memory 14, and an application-specific integrated circuit (ASIC) 15, all of which are interconnected via a bus line. The interface 16, the ink heads 2, and the conveying motor 22 are also connected to the ASIC 15.

The CPU 11 controls each function possessed by the printer 1 and each component connected to the ASIC 15 based on fixed values and programs stored in the ROM 12 and the flash memory 14. The ROM 12 is a nonwritable memory device that stores various programs executed on the printer 1, as well as a dot size table 12*a* and a Y-direction nozzle distance table 12*b* described later with reference to FIGS. 5(*a*) and 5(*c*). The ROM 12 also stores a dot size setting program 12*c* for implementing a dot size setting process shown in the flowchart of FIG. 6. The RAM 13 is a nonvolatile memory device that allows stored data to be overwritten. The RAM 13 temporarily stores various data required in operations executed on the printer 1. The flash memory 14 is a nonvolatile memory device that allows stored data to be overwritten. The flash memory 14 stores a dot size adjusting table 14*a* described later with reference to FIG. 5.

The controller 10 acquires image data for printing processes after the data has undergone a halftone process to convert each pixel value to one of n values (levels). Here, n is an integer. The controller 10 may acquire this image data via the interface 16, for example, or may execute the halftone process on data acquired from an external source via the interface 16 to obtain the image data. In the embodiment, the controller 10 acquires four-level image data (that is, n=4), with each pixel value set to one of the values "large dot," "medium dot," "small dot," or "no dot." The controller 10 adjusts (determines) the quantity of ink ejected from each nozzle 2*c* based on the value for each pixel in the image data and the dot size values set in the dot size table 12*a* for described later.

The controller 10 may adjust the quantity of ink ejected from the nozzles 2*c* according to one of many methods. For example, if the ink head 2 is configured of piezoelectric elements for ejecting ink, the controller 10 may adjust the quantity of ejected ink by adjusting the amount of piezoelectric deformation through voltage control.

FIG. 5(*a*) is an explanatory diagram conceptually illustrating the structure of the dot size table 12*a*. The dot size table 12*a* shown in FIG. 5(*a*) stores three (that is, n−1) sets of dot sizes, each set including a large dot size value representing the diameter of a large dot, a medium dot size value representing the diameter of a medium dot, and a small dot size value representing the diameter of a small dot. Each dot size value shown in FIG. 5(*a*) represents the diameter of a dot in units of micrometers that is to be formed on the paper P. Therefore, a larger dot size value represents a dot of a larger size.

In the dot size table 12*a* according to the embodiment, three patterns of dot size values have been prepared as dot size value sets 1-3. The dot size value applied to each nozzle 2*c* is determined based on the distance between dots. Specifically, when the distance between positions of dots formed by adjacent nozzles 2*c* is great, dot size value set 3, which is the set having the largest dot sizes, is applied to the nozzles 2*c*. Similarly, when the distance between positions of dots formed by adjacent nozzles 2*c* is small, dot size value set 1, which has the smallest dot sizes, is applied to the nozzles 2*c*.

The dot size value set applied to each nozzle 2*c* is determined according to a dot size setting process described later with reference to FIG. 6. When a large dot is to be formed on the paper P using a certain nozzle 2*c*, the dot size value set for this nozzle 2*c* is determined so as not to produce a gap between this large dot and another adjacent large dot.

The controller 10 sets the quantity of ink to be ejected from each nozzle 2*c* based on the dot size value set selected for the nozzle 2*c* and the value of the corresponding pixel in the image data ("large dot," "medium dot," "small dot," or "no dot"). For example, if the dot size value set 3 has been selected for a certain nozzle 2*c* and the value of the pixel to be formed by this nozzle 2*c* is "large dot," the controller 10 adjusts the quantity of ink to be ejected from the nozzle 2*c* in order to form a large dot having an 8-μm diameter. If the pixel value is "medium dot," the controller 10 forms a medium dot having a 5-μm diameter. If the pixel value is "small dot," the controller 10 forms a small dot having a 3-μm diameter. If the pixel value is "no dot," the controller 10 does not eject an ink droplet.

Here, the smallest size among large dots size values in the dot size table 12*a* (6 μm in the example of FIG. 5(*a*)) is set so as to be greater than the maximum size among medium dots size values in the dot size table 12*a* (5 μm in the example of FIG. 5(*a*)).

By setting the smallest size of a large dot corresponding to a large dot size value greater than the maximum size of a medium dot corresponding to the medium dot size value in this way, the printer 1 ensures that the ink head 2 prints images while maintaining the gradation relationship among pixels in the image data. In other words, the printer 1 prevents a large dot formed for one pixel from being smaller than a medium dot formed for another pixel.

FIG. 5(*b*) conceptually illustrates the structure of the dot size adjusting table 14*a*. The dot size adjusting table 14*a* stores numbers representing the dot size value sets selected for all nozzles 2*c* in the dot size setting process described later with reference to FIG. 6. In the embodiment, m nozzles are formed in each ink head 2. The nozzles 2*c* are referred to as a $1^{st}$ nozzle, $2^{nd}$ nozzle, . . . in order beginning from the leftmost nozzle 2*c* from a perspective facing the ink ejection surface 2*a*, while the rightmost nozzle 2*c* is referred to as the $m^{th}$ nozzle.

In the dot size adjusting table 14*a* shown in the example of FIG. 5(*b*), the dot size value set 3 has been stored for the $4^{th}$ nozzle. Accordingly, it is clear that the distance between the pair of dots formed by the $4^{th}$ and $3^{rd}$ nozzles or the distance between the pair of dots formed by the $4^{th}$ and $5^{th}$ nozzles is large. By applying the dot size value set 3 to the $4^{th}$ nozzle in this way, it is possible to form a large dot with an 8-μm diameter, which is the maximum size among large dot size values, thereby suppressing the generation of a gap between adjacent dots.

The printer 1 according to the embodiment adjusts the quantity of ink ejected from each nozzle 2*c* based on the dot size value set that is selected for each nozzle 2*c* and the value of the corresponding pixel in the image data so that the size of the dots formed by a pair of nozzles 2*c* adjacent to each other along the X direction is larger when the distance in the B direction between the pair of dots formed by this pair of nozzles 2*c* is larger. That is, the controller 10 determines the dot size value set for the nozzle 2*c* by referring to the dot size adjusting table 14*a*, and determines the quantity of ink to be ejected from the nozzle 2*c* by referring to the dot size table 12*a* based on the determined dot size value set and the value of the pixel in the image data. As a result, the printer 1 can suppress the generation of gaps between dots constituting the dot row 40, thereby suppressing the appearance of banding in an image printed by the ink head 2.

As shown in FIG. 5(*a*), each dot size value set includes a number of dot size values equivalent to the value of (n−1), or "3" in this example. Hence, three dot size values are stored for each nozzle 2*c* in the dot size table 12*a*. In the case where the halftone process converts the pixel value into one of n the value, the dot size table 12*a* may stores (n−1) dot size values for each of the dot size value sets. Accordingly, the printer 1 can also suppress banding in images when the image data is generated by converting each pixel value to a value of "3" or greater.

FIG. 5(*c*) conceptually illustrates the structure of the Y-direction nozzle distance table 12*b*. As shown in FIG. 5(*c*), the Y-direction nozzle distance table 12*b* stores Y-direction nozzle distances representing the change in position in the Y-direction between nozzles 2*c* formed adjacent to each other in the X-direction. The Y-direction nozzle distance is set to a positive value when the direction of change is toward the upstream side in the conveying direction A, and to a negative value when the direction of change is toward the downstream side in the conveying direction A. That is, the change in position indicates a value obtained by subtracting a position of a nozzle 2*c* from a position of another nozzle 2*c* that is positioned at downstream side of and adjacent to the nozzle 2*c* in the X direction.

As described above, the nozzles 2*c* are arranged at irregular positions in the Y direction. Hence, when the mounting angle of the ink head 2 is incorrect, as in the example shown in FIG. 3(*b*), the controller 10 can calculate the distance between dots produced in the dot row 40 based on the angle formed by the X direction of the ink head 2 and the B direction of the dot row 40, and the Y-direction nozzle distance. This method of calculation will be described later with reference to FIG. 7(*a*). However, the printer 1 according to the embodiment calculates the distance between dots based on the Y-direction nozzle distance and selects a suitable dot size value set for each nozzle 2*c* based on the calculated distances.

Figure 6:
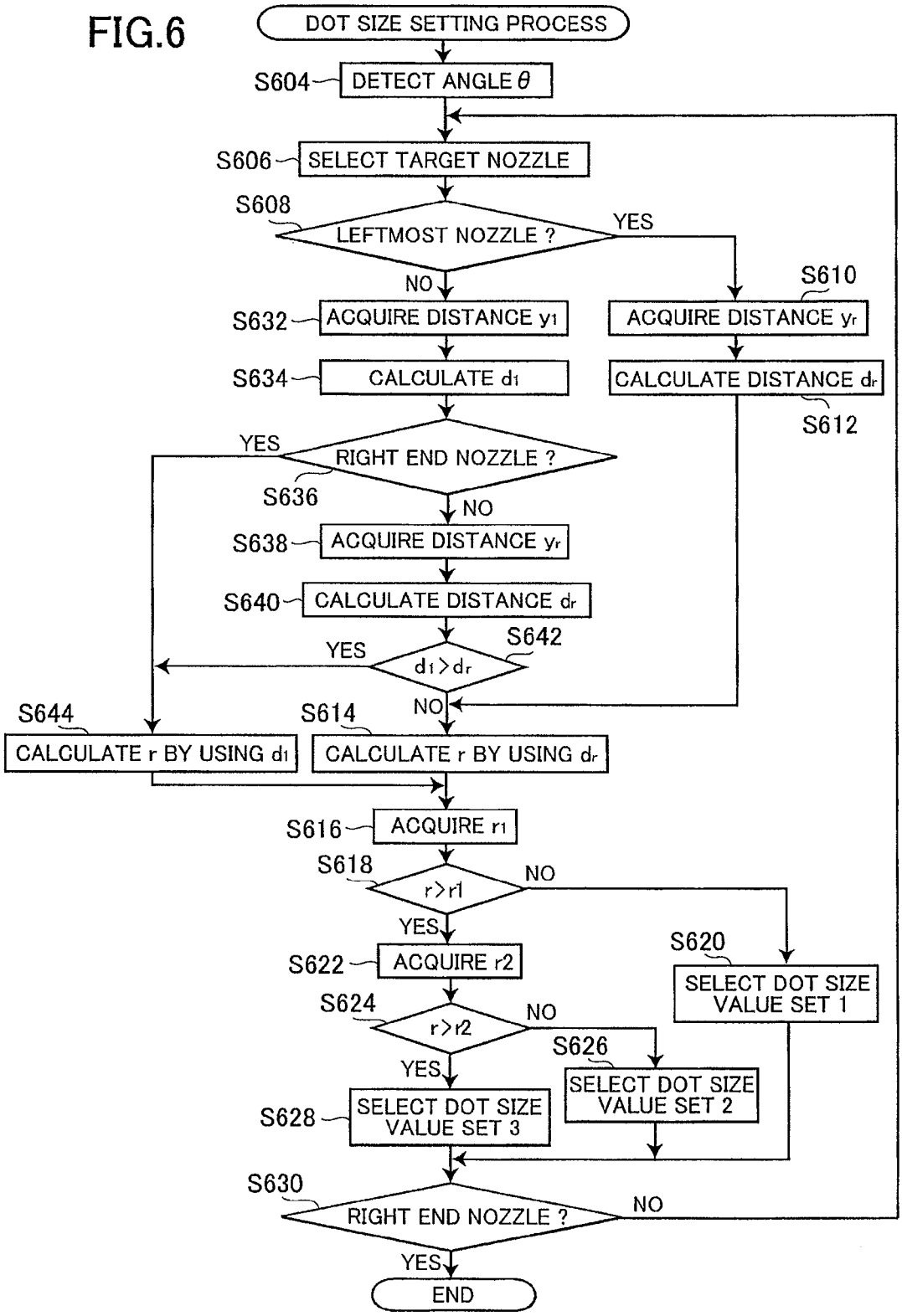
FIG. 6 is a flowchart illustrating steps in a dot size setting process.

FIG. 6 is a flowchart illustrating steps in the dot size setting process. This process is performed on the printer 1 at the factory prior to shipping. In the embodiment, the CPU 11 of the controller 10 executes the dot size setting process according to the dot size setting program 12*c*, but the process may be executed using an external device instead. Through this process, dot size value sets selected for each nozzle 2*c* are stored in the dot size adjusting table 14*a*. In subsequent printing operations performed on the printer 1, the controller 10 references the dot size adjusting table 14*a* to adjust the quantities of ejected ink.

The dot size setting process is executed for each ink head 2 corresponding to each color used in the printer 1. Since the process executed for each ink head 2 is identical, the process will be described only once for an ink head 2 corresponding to one color.

In S604 at the beginning of the dot size setting process, the CPU 11 detects an inclination angle θ (angular data) for the ink head 2 formed by the longitudinal direction of the ink head 2 (X direction) and the longitudinal direction of the dot row 40 printed on the paper P (B direction). Specifically, the ink head inclination angle θ is an angle of 90 degrees or less formed by the X direction and the B direction about an axis perpendicular to the surface of the paper P, and is defined as a positive angle when the X direction of the ink head 2 is shifted clockwise to the B direction on the surface of the paper P and a negative angle when the X direction is shifted counterclockwise to the B direction. This ink head inclination angle θ can be calculated based on the results of reading the marks 81 formed on the outer surface 8*a* using a photosensor 25 disposed on the ink ejection surface 2*a*. There are various methods for finding this ink head inclination angle θ, but these methods are well known in the art and, hence, a detailed description will not be provided here.

In S606 the CPU 11 selects a target nozzle 2*c*, beginning from the first nozzle 2*c* on the left end toward the left end nozzle 2*c*. In S608 the CPU 11 determines whether the target nozzle 2*c* is the leftmost nozzle. If the target nozzle 2*c* is the leftmost nozzle (S608: YES), in S610 the CPU 11 acquires a Y-direction nozzle distance $y_r$ between the target nozzle 2*c* and the $2^{nd}$ nozzle 2*c* adjacent to the target nozzle 2*c* on the right side. In S612 the CPU 11 calculates a distance $d_r$ between two adjacent dots in the B direction based on the ink head inclination angle θ acquired in S604 and the Y-direction nozzle distance $y_r$ acquired in S610.

$$d_r = x\cos\theta + y_r\sin\theta \tag{1}$$

In S614 the CPU 11 calculates an ideal large dot size r based on the distance $d_r$ calculated in S612 according to the following Equation (2). Here, $d_A$ is a predetermined length indicating a distance in the direction A and determined as an inverse of the printing resolution of the image.

$$r = (d_r^2 + d_A^2)^{1/2} \tag{2}$$

Figure 7A:
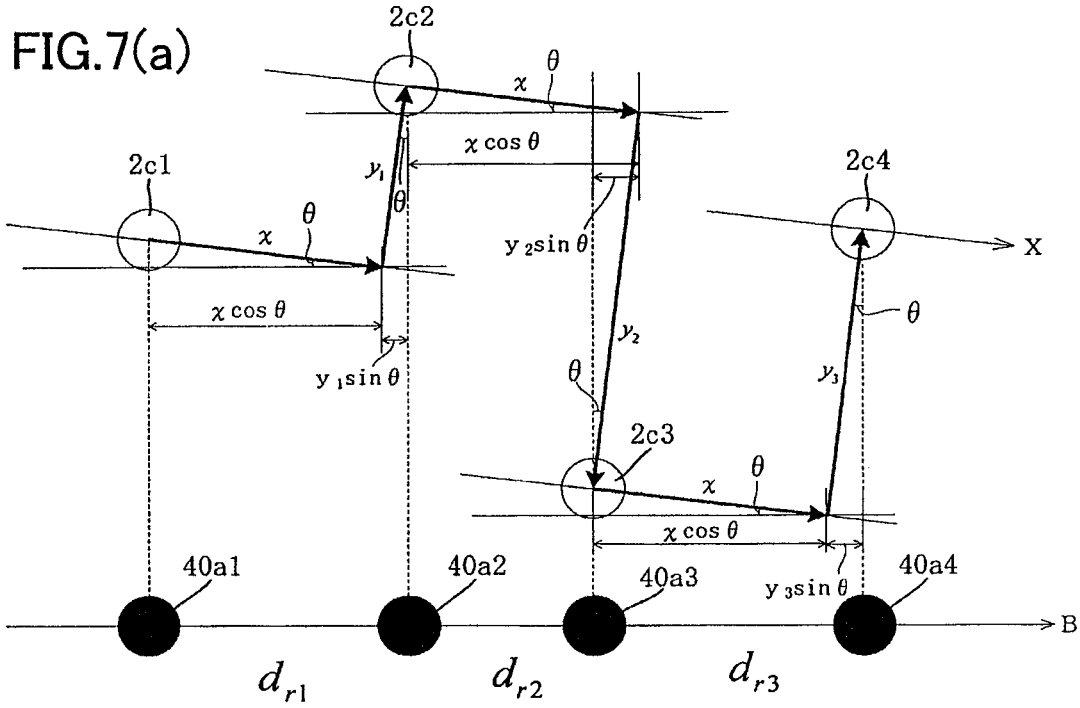
FIG. 7(*a*) is an explanatory diagram illustrating how a distance between dots is calculated.
Figure 7B:
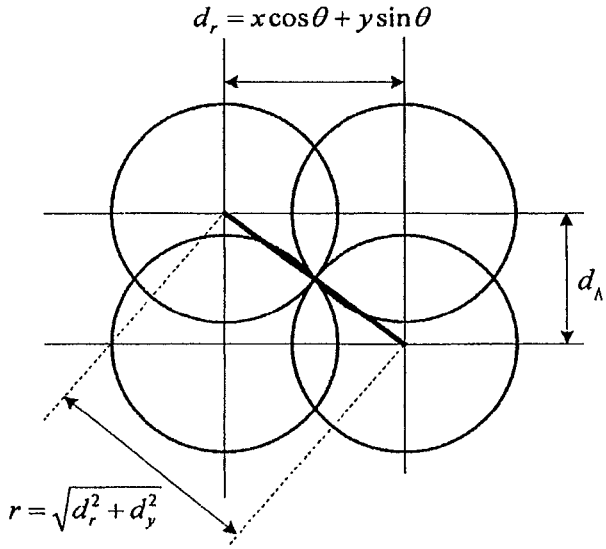

Next, Equations (1) and (2) will be described with reference to FIGS. 7(*a*) and 7(*b*). FIG. 7(*a*) illustrates how the distance between dots is calculated according to Equation (1). FIG. 7(*a*) shows the relationships between $1^{st}$ through $4^{th}$ nozzles 2*c*1-2*c*4 and dots 40*a*1-40*a*4 formed by the $1^{st}$ through $4^{th}$ nozzles 2*c*1-2*c*4 along a line parallel to the direction A. As described above, the inclination angle θ is formed by the X direction following the longitudinal direction of the ink head 2 and the B direction following the longitudinal direction of the dot row 40. Further, $y_i$ in FIG. 7(*a*) indicates the nozzle distance between an $i^{th}$ nozzle and an $(i+1)^{th}$ nozzle.

In the example shown in FIG. 7(*a*), a distance $d_{r1}$ between the dot 40*a*1 formed by the $1^{st}$ nozzle 2*c*1 and the dot 40*a*2 formed by the $2^{nd}$ nozzle 2*c*2 is expressed by the sum of the B directional component of x (x cos θ), which is the distance between the $1^{st}$ nozzle 2*c*1 and the $2^{nd}$ nozzle 2*c*2 in the X direction, and the B directional component of $y_1$ ($y_1$ sin θ), which is the distance between the $1^{st}$ nozzle 2*c*1 and the $2^{nd}$ nozzle 2*c*2 in the Y direction. Hence, the distance $d_r$ between dots can be calculated according to Equation (1).

Similarly, in the example of FIG. 7(*a*), a distance $d_{r2}$ between the dot 40*a*2 formed by the $2^{nd}$ nozzle 2*c*2 and the dot 40*a*3 formed by the $3^{rd}$ nozzle 2*c*3 is expressed by the sum of the B directional component of x (x cos θ), which is the distance between the $2^{nd}$ nozzle 2*c*2 and the $3^{rd}$ nozzle 2*c*3 in the X direction, and the B directional component of $y_2$ ($y_2$ sin θ), which is the distance between the $2^{nd}$ nozzle 2*c*2 and the $3^{rd}$ nozzle 2*c*3 in the Y direction. Since the Y position of each nozzle is set in the embodiment so that the Y component value of the position decreases when the position, shifts in the conveying direction A, the B directional component for $y_2$ ($y_2$ sin θ) is a negative value.

Thus, in the embodiment, Equation (1) described above is used to calculate the distance $d_r$ between dots, whether the dots are positioned closely together or far apart. Although FIG. 7(*a*) shows an example in which the X direction of the ink head 2 is shifted clockwise to the B direction (i.e., the ink head inclination angle θ is positive and sin θ is positive), the same Equation (1) may be used for the opposite case. In other words, the distance $d_r$ between dots can be calculated using Equation (1) when the X direction of the ink head 2 is shifted counterclockwise relative to the B direction (i.e., the ink head inclination angle θ is negative and sin θ is negative).

FIG. 7(*b*) illustrates the method of calculating the ideal large dot size r according to Equation (2). In FIG. 7(*b*), Equation (2) is expressed using a square root sign, which is identical to the meaning of Equation (2) described above. In FIG. 7(*b*), the ideal large dot size r is set so that two dots along the same diagonal line in a 2×2 dot area are in contact with each other. That is, the ideal large dot size r is equal to a sum of radii of the two large dots positioned at the ends of the diagonal line. Or, the ideal large dot size is equal to a distance between centers of two dots positioned on the diagonal line. In other words, when a dot belonging to a first dot row 40 and a dot belonging to a second dot row 40 adjacent to the first dot row 40 are large dots ejected through a pair of nozzles 2*c* adjacent to each other in the longitudinal direction of the ink head 2, the size value for these large dots is ideally set so that the dots are in contact with each other on the paper P.

By finding an ideal large dot size r in this way, the controller 10 can suppress the occurrence of gaps between dots having a diagonal positional relationship on the paper P when setting the dot size value set to be applied to the target nozzle in a subsequent step. Hence, the controller 10 can further suppress banding in the image.

The distance between dot rows 40 is determined by the printing resolution. This example will assume that the resolution is 600 dpi in the conveying direction A of the paper P. In this case, each distance $d_A$ between two dot is uniformly 1/600 inches. Since the distance $d_r$ between a pair of neighboring dots can found as described in FIG. 7(*a*), the controller 10 can easily calculate the ideal large dot size r.

Returning to the flowchart in FIG. 6, in S616 the CPU 11 acquires a large dot size value r1 in the dot size value set 1 from the dot size table 12*a* (see FIG. 5(*a*)). In S618 the CPU 11 determines whether the ideal large dot size r is greater than the large dot size value r1 acquired in S616. If r≦r1 (S618: NO), in S620 the CPU 11 selects the dot size value set 1 for the target nozzle and stores this value ("1") as a dot size value set for the target nozzle in the dot size adjusting table 14*a*.

However, if r>r1 (S618: YES), in S622 the CPU 11 acquires a large dot size value r2 in the dot size value set 2 from the dot size table 12*a*. In S624 the CPU 11 determines whether the ideal large dot size r is greater than the large dot size value r2 acquired in S622. If r≦r2 (S624: NO), in S626 the CPU 11 selects the dot size value set 2 for the target nozzle and stores this value ("2") as a dot size value set for the target pixel in the dot size adjusting table 14*a*.

However, if the CPU 11 determines that r>r2 (S624: YES), in S628 the CPU 11 selects the dot size value set 3 for the target nozzle and stores this value ("3") as a dot size value set for the target pixel in the dot size adjusting table 14*a*. Thus, the CPU 11 can set and store, for each target nozzle, one of three dot size sets by which one of a large dot, medium dot, and small dot is determined.

Hence, the controller 10 selects a dot size value set specifying a greater large dot size value for the target nozzle when the ideal large dot size is larger.

In S630 the CPU 11 determines whether the above process has been completed through the $m^{th}$ nozzle on the right end. If there remain nozzles to be processed (S630: NO), the CPU 11 returns to S606 to select the next nozzle to the right as the target nozzle and repeats the above process. Since the target nozzle is no longer the leftmost nozzle (S608: NO), in S632 the CPU 11 acquires a Y direction nozzle distance $y_1$ between the target nozzle and the nozzle adjacent to the target nozzle on the left side. In S634 the CPU 11 calculates a distance $d_1$ in the direction B between two adjacent dots to be formed by the target nozzle 2*c* and a nozzle 2*c* adjacent to the target nozzle on the left side in the X direction, based on the ink head inclination angle θ and the Y direction nozzle distance $y_1$ according to Equation (3) below.

$$d_1 = x\cos\theta + y_1\sin\theta \tag{3}$$

Since Equation (3) is derived according to the same principles as Equation (1), a detailed description of this equation will not be repeated here.

In S636 the CPU 11 determines whether the target nozzle is the $m^{th}$ nozzle on the right end. Since this is the first time the CPU 11 is performing the process in S636 in this description (i.e., since the target nozzle is not the $m^{th}$ nozzle on the right end; S636: NO), in S638 the CPU 11 acquires the Y-direction nozzle distance $y_r$ between the target nozzle 2*c* and a nozzle 2*c* adjacent to the target nozzle on the right side. In S640 the CPU 11 calculates the distance $d_r$ in the direction B between two adjacent dots to be formed by the target nozzle 2*c* and the nozzle 2*c* adjacent to the target nozzle 2*c* on the right side in the X direction, based on the ink head inclination angle θ and the Y-direction nozzle distance $y_r$ according to Equation (1).

In S642 the CPU 11 determines whether the distance $d_1$ to the adjacent nozzle 2*c* on the left side is greater than the distance $d_r$ to the adjacent nozzle 2*c* on the right side. If $d_1 \leqq d_r$ (S642: NO), in S614 the CPU 11 calculates the ideal large dot size r using the distance $d_r$ between two dots with respect to the target nozzle 2*c* and the adjacent nozzle 2*c* on the right according to Equation (2) described above.

However, when $d_1 > d_r$ (S642: YES), in S644 the CPU 11 calculates the ideal large dot size r using the distance $d_1$ between two dots with respect to the target nozzle 2*c* and the adjacent nozzle 2*c* on the left according to Equation (4) below.

$$r = (d_1^2 + d_A^2)^{1/2} \tag{4}$$

Since Equation (4) is derived according to the same principles as Equation (2) described above, a detailed description of this equation will not be repeated here.

Subsequently, the processes in S616 through S630 are repeated. Through this process, when the distance $d_1$ to the nozzle 2*c* on the left of the target nozzle in the X direction of the ink head 2 differs from the distance $d_r$ to the nozzle 2*c* on the right, the controller 10 can select a dot size value set for the target nozzle based on the larger dot distance.

By controlling the ink head 2 to print an image based on the dot size value set selected in the above process, the controller 10 can further suppress the occurrence of gaps between dots in the printed image, thereby satisfactorily suppressing the occurrence of banding in the image.

When the distances between the target nozzle and the left and right nozzles 2*c* are equivalent, the printer 1 according to the embodiment selects a dot size value set based on the distance $d_1$. However, the printer 1 may be instead configured to select a dot size value set based on the distance $d_r$.

By repeatedly performing the above process for each nozzle, the $m^{th}$ nozzle on the right end is eventually set as the target nozzle. When the controller 10 determines that the target nozzle is the $m^{th}$ nozzle on the right end (S636: YES), in S644 the controller 10 sets the ideal large dot size r based on the distance $d_1$ in the direction B between two adjacent dots to be formed by the $m^{th}$ nozzle and the adjacent $(m^{-1})^{th}$ nozzle to the left and selects a dot size value set for the $m^{th}$ nozzle based on this ideal large dot size r. Subsequently, the controller 10 determines in S630 that the process has been completed for the $m^{th}$ nozzle on the right end (S630: YES) and ends the dot size setting process.

Through the dot size setting process according to the embodiment, the printer 1 can create a dot size adjusting table 14*a* including a dot size value set associated with each nozzle 2*c*, where the dot size value sets are selected so that the size of dots to be formed by a pair of nozzles 2*c* adjacent in the X direction is larger when the distance between the dots to be formed by the pair of nozzles 2*c* in the longitudinal direction of the dot row 40 is greater. In other words, the size of the dot indicated by the dot size value set is larger as the distance in the Y direction between the nozzle 2*c* corresponding to the dot size value set and another nozzle 2*c* adjacent to the nozzle 2*c* in the X direction is greater. Further, the dot size value set is defined based on the ideal large dot size r. Each dot size value set is determined dependently on a distance ($d_1$ or $d_r$) in the B direction between two dots which are to be formed by the nozzle corresponding to the dot size value set and another nozzle adjacent to the nozzle in the X direction and which are arranged in the B direction. Here, the distance ($d_1$ or $d_r$) in the B direction is determined dependently on the angle θ and a distance y in the Y direction between the nozzle 2*c* corresponding to the dot size value set and another nozzle 2*c* adjacent to the nozzle 2*c* in the X direction.

Further, the printer 1 according to the embodiment can accurately calculate the distance between two adjacent dots based on the Y direction nozzle distance and the ink head inclination angle θ. As a result, the printer 1 can select suitable dot size value sets for suppressing the occurrence of banding in images based on these accurately calculated distances.

While the invention has been described in detail with reference to the embodiment thereof, it would be apparent to those skilled in the art that various changes and modifications may be made therein without departing from the spirit of the invention.

In the embodiment described above, a dot size adjusting table 14*a* is prepared with correlations between the nozzles 2*c* and dot size value sets. However, the printer 1 may employ a table with correlations between the nozzles and dot size values instead. In this case, all dot size values (sizes of large dot, medium dot, and small dot, in the embodiment) corresponding to the determined dot size value set are stored in the table in association with each nozzle. Alternatively, one of the dot size values (for example, large dot size value) corresponding to the determined dot size value set may be stored in the table in association with each nozzle.

In the embodiment described above, the dot size setting process of FIG. 6 is performed on the printer 1 at the factory prior to shipping. However, the printer 1 may be configured to execute the dot size setting process in response to a user command in order to account for changes in the characteristics of the printer 1 over time.

The dot size values in the dot size table 12*a* of the embodiment described above correspond to the diameters of dots, but the dot size values may be any values that correspond to the sizes of dots. For example, the dot size values may express quantities of ejected ink. Further, the dot size values may be modified according to various designs.

For example, the following values may be stored in the dot size table 12*a*. In the dot size value set 3, the large dot size value may be set to "9", the medium dot size value to "6", and the small dot size value to "3". In the dot size value set 2, the large dot size value may be set to "8", the medium dot size value to "5", and the small dot size value to "2". In the dot size value set 1, the large dot size value may be set to "7", the medium dot size value to "4", and the small dot size value to "1". Since the smallest medium dot size value ("4" in this variation) is greater than the largest small dot size value ("3" in this variation), the above values preserve the gradation relationship between medium and small dots.

In the embodiment described above, the construction for finding the inclination angle θ of the ink head 2 formed by the X direction and the B direction is provided in the printer 1, but it is not necessary that this construction be provided in the printer 1.

What is claimed is:

1. A print controller controlling an inkjet head to eject ink to record an image on a recording medium conveyed in a conveying direction, the inkjet head having a plurality of nozzles that are arranged such that a plurality of corresponding distances in a first direction between nozzles that are adjacent with each other in the first direction are uniform and a plurality of corresponding distances in a second direction orthogonal to the first direction between the nozzles that are adjacent with each other in the first direction are nonuniform, the print controller comprising:

an acquiring unit that acquires image data representing an image having a plurality of pixels, the image data including a plurality of sets of pixel data corresponding to the plurality of pixels;

a storing unit that stores a plurality of dot size determining values corresponding to the plurality of nozzles, each dot size determining value being defined to determine a size of a dot to be formed by the corresponding nozzle and being determined dependently on a distance in the second direction between the corresponding nozzle and a nozzle adjacent to the corresponding nozzle in the first direction; and a determining unit that determines a size of a dot to be formed by each nozzle based on the pixel data and the corresponding dot size determining value, wherein each dot size determining value is defined according to a greater one of a first distance and a second distance, the first distance indicating a distance between two dots which are to be formed on the recording medium by the corresponding nozzle and a first adjacent nozzle and which are to be arranged in a third direction orthogonal to the conveying direction, the first adjacent nozzle being located adjacent to the corresponding nozzle in the first direction, the second distance indicating a distance between two dots which are to be formed on the recording medium by the corresponding nozzle and a second adjacent nozzle and which are to be arranged in the third direction, the second adjacent nozzle being located adjacent to the corresponding nozzle in the first direction on an opposite side of the first adjacent nozzle with respect to the corresponding nozzle.

2. The print controller according to claim 1, wherein each dot size determining value is defined such that the size of the dot indicated by the each dot size determining value is larger as the distance in the second direction between the corresponding nozzle and the nozzle adjacent to the corresponding nozzle in the first direction is greater.

3. The print controller according to claim 1, wherein each set of pixel data is represented by a n-th level value, n being an integer larger than three, wherein the storing unit stores (n−1) worth of dot size values for each dot size determining value, the (n−1) worth of dot size values representing sizes of (n−1) number of dots to be formed on the recording medium by the corresponding nozzle.

4. A print controller controlling an inkjet head to eject ink to record an image on a recording medium conveyed in a conveying direction, the inkjet head having a plurality of nozzles that are arranged such that a plurality of corresponding distances in a first direction between nozzles that are adjacent with each other in the first direction are uniform and a plurality of corresponding distances in a second direction orthogonal to the first direction between the nozzles that are adjacent with each other in the first direction are nonuniform, the print controller comprising:

an acquiring unit that acquires image data representing an image having a plurality of pixels, the image data including a plurality of sets of pixel data corresponding to the plurality of pixels;

a storing unit that stores a plurality of dot size determining values corresponding to the plurality of nozzles, each dot size determining value being defined to determine a size of a dot to be formed by the corresponding nozzle and being determined dependently on a distance in the second direction between the corresponding nozzle and a nozzle adjacent to the corresponding nozzle in the first direction; and a determining unit that determines a size of a dot to be formed by each nozzle based on the pixel data and the corresponding dot size determining value, wherein each set of pixel data is represented by a n-th level value, n being an integer larger than three, wherein the storing unit stores (n−1) worth of dot size values for each dot size determining value, the (n−1) worth of dot size values representing sizes of (n−1) number of dots to be formed on the recording medium by the corresponding nozzle, wherein the print controller is capable of controlling the plurality of nozzles to form a first dot line and a second dot line adjacent to the first dot line on the recording medium in the conveying direction, the first dot line and the second dot line extending in a third direction orthogonal to the conveying direction, and wherein each dot size determining value is defined based on a reference size, the reference size being defined such that a first dot which has the reference size and which is to be formed on the first line by the corresponding nozzle contacts a second dot which has the reference size and which is to be formed on the second line by another nozzle, the another nozzle being adjacent to the corresponding nozzle in the first direction.

5. The print controller according to claim 4, wherein the (n−1) worth of dot size values of each dot size determining value includes a first dot size value that is a largest value among the (n−1) dot size values and a second dot size value that is a second largest value among the (n−1) worth of dot size values, a minimum size among first dot sizes of all dot size determining values being larger than a maximum size among second dot sizes of all dot size determining values.

6. A print controller controlling an inkjet head to eject ink to record an image on a recording medium conveyed in a conveying direction, the inkjet head having a plurality of nozzles that are arranged such that a plurality of corresponding distances in a first direction between nozzles that are adjacent with each other in the first direction are uniform and a plurality of corresponding distances in a second direction orthogonal to the first direction between the nozzles that are adjacent with each other in the first direction are nonuniform, the print controller comprising:

an acquiring unit that acquires image data representing an image having a plurality of pixels, the image data including a plurality of sets of pixel data corresponding to the plurality of pixels;

a storing unit that stores a plurality of dot size determining values corresponding to the plurality of nozzles, each dot size determining value being defined to determine a size of a dot to be formed by the corresponding nozzle and being determined dependently on a distance in the second direction between the corresponding nozzle and a nozzle adjacent to the corresponding nozzle in the first direction; and a determining unit that determines a size of a dot to be formed by each nozzle based on the pixel data and the corresponding dot size determining value, wherein each dot size determining value is determined dependently on a distance in a third direction perpendicular to the conveying direction between two dots which are to be formed by the corresponding nozzle and another nozzle adjacent to the corresponding nozzle in the first direction and which are arranged in the third direction, the distance being determined dependently on an angle between the first direction and the third direction.

7. The print controller according to claim 6, wherein the distance is determined dependently on the angle and another distance in the second direction between the corresponding nozzle and the another nozzle adjacent to the corresponding nozzle in the first direction.

8. A print controller controlling an inkjet head to eject ink to record an image on a recording medium conveyed in a conveying direction, the inkjet head having a plurality of nozzles that are arranged such that a plurality of corresponding distances in a first direction between nozzles that are adjacent with each other in the first direction are uniform and a plurality of corresponding distances in a second direction orthogonal to the first direction between the nozzles that are adjacent with each other in the first direction are nonuniform, the print controller comprising:

an acquiring unit that acquires image data representing an image having a plurality of pixels, the image data including a plurality of sets of pixel data corresponding to the plurality of pixels;

a storing unit that stores a plurality of dot size determining values corresponding to the plurality of nozzles, each dot size determining value being defined to determine a size of a dot to be formed by the corresponding nozzle and being determined dependently on a distance in the second direction between the corresponding nozzle and a nozzle adjacent to the corresponding nozzle in the first direction;

a determining unit that determines a size of a dot to be formed by each nozzle based on the pixel data and the corresponding dot size determining value;

an angle acquiring unit that acquires an angle between the first direction and a third direction orthogonal to the conveying direction; and a calculating unit that calculates, for each nozzle, a distance in the third direction between two dots which are to be formed by the each nozzle and another nozzle adjacent to the each nozzle in the first direction and which are to be arranged in the third direction, the distance being calculated based on the angle, wherein the dot size determining value for each nozzle is defined based on the distance calculated by the calculating unit for the each nozzle.

9. The print controller according to claim 8, further comprising a distance acquiring unit that acquires, for each nozzle, another distance in the second direction between the each nozzle and the another nozzle, wherein the calculating unit calculates the distance based on the angle and the another distance.

10. A printing device comprising:

an inkjet head that ejects ink to record an image on a recording medium conveyed in a conveying direction, the inkjet head having a plurality of nozzles that are arranged such that a plurality of corresponding distances in a first direction between nozzles that are adjacent with each other in the first direction are uniform and a plurality of corresponding distances in a second direction orthogonal to the first direction between the nozzles that are adjacent with each other in the first direction are nonuniform;

an acquiring unit that acquires image data representing an image having a plurality of pixels, the image data including a plurality of sets of pixel data corresponding to the plurality of pixels;

a storing unit that stores a plurality of dot size determining values corresponding to the plurality of nozzles, each dot size determining value being defined to determine a size of a dot to be formed by the corresponding nozzle and being determined dependently on a distance in the second direction between the corresponding nozzle and a nozzle adjacent to the corresponding nozzle in the first direction; and a determining unit that determines a size of a dot to be formed by each nozzle based on the pixel data and the corresponding dot size determining value, wherein the first direction is shifted from a third direction that is perpendicular to the conveying direction by a prescribed angle.

11. The printing device according to claim 10, wherein each dot size determining value is defined such that the size of the dot indicated by the each dot size determining value is larger as the distance in the second direction between the corresponding nozzle and the nozzle adjacent to the corresponding nozzle in the first direction is greater.

12. A method for setting a printing device having an inkjet head to record an image on a recording medium conveyed in a conveying direction, the inkjet head having a plurality of nozzles that are arranged such that a plurality of corresponding distances in a first direction between nozzles that are adjacent with each other in the first direction are uniform and a plurality of corresponding distances in a second direction orthogonal to the first direction between the nozzles that are adjacent with each other in the first direction are nonuniform, the method comprising:

acquiring an angle between the first direction and a third direction orthogonal to the conveying direction;

calculating, for each nozzle, a distance in the third direction between two dots which are to be formed by the each nozzle and another nozzle adjacent to the each nozzle in the first direction and which are to be arranged in the third direction, the distance being calculated based on the angle; and setting a plurality of dot size determining values corresponding to the plurality of nozzles dependently on a distance in the second direction between the corresponding nozzle and a nozzle adjacent to the corresponding nozzle in the first direction, each dot size determining value being set to determine a size of a dot to be formed by the corresponding nozzle.

13. The method according to claim 12, wherein each dot size determining value is set such that the size of the dot indicated by the each dot size determining value is larger as the distance in the second direction between the corresponding nozzle and the nozzle adjacent to the corresponding nozzle in the first direction is greater.

* * * * *